137-13

4/15/80 OR 4,197,869 SR

United States Patent [19]

Moncrieff-Yeates

[11] 4,197,869

[45] Apr. 15, 1980

[54] METHOD AND APPARATUS FOR GENERATING A STABLE VORTEX FLUID FLOW PATTERN

[76] Inventor: Alexander J. Moncrieff-Yeates, 8924 Rhyme Ct., Annadale, Va. 22003

[21] Appl. No.: 868,428

[22] Filed: Jan. 10, 1978

Related U.S. Application Data

[63] Continuation-in-part of Ser. No. 828,930, Aug. 29, 1977, Pat. No. 4,131,105, which is a continuation-in-part of Ser. No. 570,798, Apr. 23, 1975, Pat. No. 4,056,091.

[51] Int. Cl.[2] ..... F15C 1/16

[52] U.S. Cl. ..... 137/13; 137/808

[58] Field of Search ..... 137/808, 809, 810, 811, 137/812, 813, 1, 13

[56] References Cited

U.S. PATENT DOCUMENTS

| | | | |
|---|---|---|---|
| 1,952,281 | 3/1934 | Ranque | 62/5 |
| 2,894,703 | 7/1959 | Hazen et al. | 137/808 X |
| 3,007,310 | 11/1961 | Eisele | 60/39.69 |
| 3,030,773 | 4/1962 | Johnson | 60/39.65 |
| 3,266,466 | 8/1966 | Fehr | 122/136 R |
| 3,396,738 | 8/1968 | Heckestad | 137/808 X |
| 3,452,772 | 7/1969 | Zaloudek | 137/809 |
| 3,508,561 | 4/1970 | Cornish | 137/808 X |

*Primary Examiner*—William R. Cline

*Attorney, Agent, or Firm*—Sixbey, Friedman & Leedom

[57] ABSTRACT

A method and apparatus produces an unrestrained vortical fluid flow pattern which is self limiting in diameter and remains stable in persistence throughout varying conditions of velocity, density, and temperature of the fluid.

16 Claims, 6 Drawing Figures

METHOD AND APPARATUS FOR GENERATING A STABLE VORTEX FLUID FLOW PATTERN

RELATED APPLICATIONS

This application is a continuation-in-part of my application entitled "Heating Unit with Aerodynamic Flow Control" filed Aug. 29, 1977, as Ser. No. 828,930, now U.S. Pat. No. 4,131,105 which in turn is a continuation-in-part of my application Ser. No. 570,798, filed Apr. 23, 1975, now U.S. Pat. No. 4,056,091.

FIELD OF THE INVENTION

This invention relates generally to the field of fluid dynamics, and more specifically to the inducement of a vortical flow pattern which finds utility in its employment as flow controllers and heat exchangers in a variety of applications, including stoves, furnaces, fireplaces, air conditioners, heat registers, auto radiators, aircraft coolers, and other areas where it is desirable to establish a vortex for purposes of fluid control or increasing fluid residence time in the area of the pattern.

BACKGROUND OF THE INVENTION—PRIOR ART

Many devices are known which create a swirling air pattern within a totally or near totally confining enclosure. Prominent among such prior art devices is the Ranque Tube refrigeration unit examplified in U.S. Pat. No. 1,952,281 issued Mar. 27, 1934 to G. J. Ranque. This patent discloses a variety of tubular elements comprising walls which completely surround the pattern area. A fluid under pressure is forcibly introduced tangentially into the tubular element so as to swirl therein and to produce two coaxial sheets of fluid. The outer sheet is compressed against the confining wall by expansive forces of the inner sheet, the compression absorbing a certain amount of work. The absorption of work is evidenced by a rise in temperature of the compressed sheet at the expense of the other sheet, which is thus cooled. Fluid extracted from the respective sheets is thus useful as hot and cold fluids.

In another prior art disclosure, namely U.S. Pat. No. 3,266,466 issued Aug. 16, 1966 to Eugene Fehr, a swirling pattern of combustion products is produced by introducing the entirety of a confined flow into a tubular conduit comprising walls which virtually totally enclosed the pattern area, i.e., including an opening only sufficient to introduce the combustion products through a restrictively confined flow path. Again, the creation and maintenance of the swirling pattern depends upon the confinement of the tubular wall which inherently imposes a viscous drag against the rotational motion of the gas. In order to maintain a consistent swirling pattern throughout the pattern area, it is necessary to match the wall radius to the pressure gradient formed as the gas progresses axially of the tubular conduit, a condition that will persist only at a given set of conditions of mass velocity of incoming and exiting combustion products. Otherwise, the flow through the tubular conduit rapidly becomes predominently an axial flow with the rotational vector diminishing or completely ceasing.

Other prior art relating to combustion chambers reveals toroidal or annular patterns of whirling fuel/air mixture created within the confining walls of the combustion chamber. See, for instance, U.S. Pat. No. 3,030,733 to R. H. Johnston and U.S. Pat. No. 3,007,310 to K. Eisele. In this prior art, the swirling motion is imparted by flow directing elements which depend again upon a high velocity entering flow and confinement by chamber walls, and are operative only under certain pre-established conditions of flow rate.

Other prior art exemplified by U.S. Pat. No. 2,894,703 issued July 14, 1959 to D. C. Hazen et al and U.S. Pat. No. 3,396,738 to G. Heskestad discloses structures in which a flow is initiated along a restrictive surface in a direction approaching a discontinuity in that surface. The presence of the restrictive surface causes the gas passing therealong to assume a laminar pattern as a result of the boundary layer phenomena. The laminar pattern is characterized by a pressure gradient which decreases with distance away from the surface approaching the discontinuity. Hence, when passing over the discontinuity, the pressure gradient is the opposite of what is desirable in establishing a stable vortex downstream of the discontinuity. At this point, both Hazen et al and Heskestad create a low pressure area adjacent the high pressure side of the laminar stream in an attempt to reverse the pressure gradient across the stream. The result is ineffective to create a smooth stable vortex, the gas entrained from the low pressure area of the laminar stream becoming turbulent, a condition counter-conducive to a stable vortex. Note that both Hazen and Heskestad find it desirable in some embodiments to exhaust gas from this turbulent area. Moreover, Hazen discloses an outer flow-directing wall which completely encircles the vortex area 40, constraining the flow completely around the circumference to the point of reentry into and entrainment with the entering air stream.

OBJECTS OF THE INVENTION

In a contradistinction to the foregoing it is among the objects of this invention to provide a vortex generator and method of operation wherein 1. a vortical flow pattern is established and maintained over widely varying conditions of temperature, density, and velocity of flow conditions,
2. a vortical flow pattern is established in an area in which viscous drag of confining wall structures is reduced,
3. a vortical fluid flow pattern is established and is permitted to expand and contract in circumference in accordance with varying conditions, including conditions of temperature, density, and velocity of the fluid.

DESCRIPTION OF DRAWINGS

The aforestated objects, as well as other objects inherent in the apparatus and method of this invention, will be apparent from a consideration of the ensuing specification and reference to the drawings, in which.

DESCRIPTION OF THE INVENTION

At the outset some comments relative to the basic nature of a vortical flow pattern are in order. A vortex is characterized by a fluid moving around an area of low pressure (density) fluid at a velocity which causes the centrifugal force on the moving fluid to equal the inward force due to the difference between the lower pressure inside the vortex and the higher pressure outside the vortex.

Self-induced, or spontaneous vortices arise in nature. Thus, a column of hot air rising from a desert causes cooler air to enter the base of the column. Any slight departure of the direction of the entering air from a radial direction toward a tangential direction will impart angular momentum to the air as it enters the column. A whirling motion is established which adds to the pressure differential which in turn increases velocity in a runaway inter effect. Ultimately, the velocity is such as to pick up sand which is visible as a "desert devil", and the energy expended in raising the sand soon dissipates the vortex, explaining its short duration.

In addition to the unconfined vortices which occur in nature ("desert devils", tornados, cyclones, etc), self-induced constrained vortices are known to occur in such environments as mine shaft vents, wherein the vortex is predominently cylindrical.

A vortex may be artifically induced by directing a flow of a fluid toward the concave surface of a curved wall, particularly tangentially to the center of the curve. A boundary layer of fluid proximate to the wall will give up heat to the wall, hence becoming more dense. At the same time, hot fluid farther away from the wall retains its heat, remaining at a relatively low density. Thus, there is created a temperature gradient increasing from the proximity of the wall toward the axis of rotation, or otherwise stated as a density or pressure gradient decreasing toward the axis. If the curved surface terminates short of a full rotation, the fluid emerging beyond the termination will have several forces acting upon it, including (1) centrifugal force and inertia tending to move the fluid in a straight line tangent to the curved surface at its termination, (2) the pressure differential tending to pull the fluid into the center of the vortex, and (3) (providing the fluid has turned back toward its entrant direction) a venturi effect caused by the stream of entering gas. When these forces can be maintained in balance, a very stable vortex pattern can be caused to persist throughout varying conditions of temperature, density, and velocity of the fluid. The key to maintenance of this critical balance of forces is the maintenance of the aforementioned pressure gradient between the axis and the outer circumference of the vortex.

Figure 1:
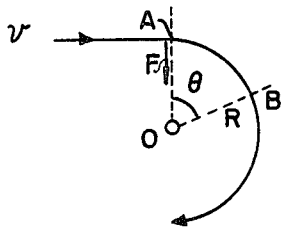
FIG. 1 is a diagram illustrating basic vortex flow principles in an unconfined fluid.

To further elaborate, a reference is made to FIG. 1, which is a diagramatic representation of an unconfined fluid of a density $\rho$ passing a point A distant R from point O with a force F acting on the fluid toward point O. With a translational velocity component $v$ perpendicular to a force gradient with a negative component k $\delta F/\delta R$ toward O, the fluid will assume a path having a locus described by the partial differential equation equating centripetal force with pressure gradient, namely $$k\frac{\delta F}{\delta R} = \frac{\rho v^2}{R},$$

-continued or $$k\frac{\delta F}{\delta R} = \rho R\dot{\theta}^2$$

where: $\dot{\theta}$ is angular velocity about point O, and k is a constant.

It is to be recognized that F and $\rho$ may well be functions of both R and $\theta$, and that R may also be a function of $\theta$ particularly for compressible fluids. So long as a component of the pressure gradient is maintained at all points of the locus, the fluid will reenter upon itself and establish a rotational motion continuously around O, described in more general terms by $$k\frac{\delta' F(R,\theta)}{\delta R} = \rho(R,\theta)R\dot{\theta}^2 \quad (1)$$

Figure 2:
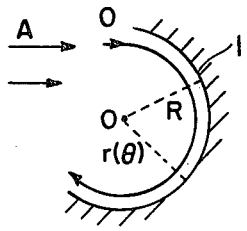
FIG. 2 is a similar diagram of a partially confined fluid.

Now, referring to FIG. 2, if this rotating mass of unconfined fluid be surrounded by a surface 1 distant r from O at any particular $\theta$ then the motion is defined to be vortical only if $$r(\theta) \geqq R \quad (2)$$

for finite ranges of $\theta$ in equation (1)

Figure 3:
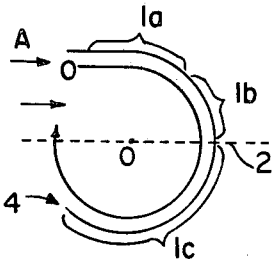
FIG. 3 is a diagram further developing flow principles employed in this invention.

If the gas entering the vortex area fills substantially the entire distance between the center O and the wall 1 and is free of any other physical constraining barrier, its free boundary may be said to define a hypothetical plane indicated at 2 in FIG. 3, said plane intersecting with the vortical core and extending in directions parallel to the path of air entering the vortex area surrounding the vortical core. The vortical core is that inner or central portion of the vortex having the lowest pressure and can be visualized as a central longitudinal axis (vortex axis) of a volume having a central axis within which the vortex resides although the vortical core need not necessarily be lineal nor stationary. The wall 1 includes a portion 1*a* which initially guides the air flow into the vortex area in a direction generally tangentially thereto, i.e. at angle of less than 30° to the circumference. The air then encounters portion 1*b* of the wall 1, portion 1*b* constituting directing means for changing the direction of flow so as to cause it to flow in a second direction through the plane 2. Centrifugal force against the wall 1 will produce a pressure gradient centered at O $$\frac{\delta P}{\delta R} = \frac{\rho R}{k}\dot{\theta}^2 \quad (3)$$

The gas, having passed through the plane 2, is now redirected by portion 1*c* of the wall 1 to a path parallel to and in the opposite direction of that of the incoming air. As the gas leaves the terminal edge 4 of surface 1*c*, the pressure gradient described by formula 3 will pull gas inwardly toward O as a result of its tendency to equalize pressure along the gradient. Thus the reentrant flow will become substantially tangent to the wall. Now, viscous drag will cause some of the gas spaced inside of the wall to rotate as a whole, forming a swirling pattern which, absent a virtually totally confining wall, would defeat the pressure gradient and cause the pattern to unwind indefinitely. The term "virtually totally confining wall" refers to a wall which encompasses the vortex area to an extent that it meets the incoming flow.

To the end that the wall 1 can be terminated short of reentry of the path of incoming air, i.e., short of intersecting or crossing the plane 2, gas is removed from the core of the vortex area centered generally on axis O at the same rate it is admitted to the vortex area. In this instance, the presence of the wall is needed only to initiate the rotational motion, which, once begun, would permit decreasing the subtense of wall 1 around axis O to the vanishing point. So long as the balance between the pressure gradient and centrifugal force as set forth in equation (1) is maintained, a self-sustaining vortex will persist.

This balance can be maintained by one or more of the following means which may be broadly termed a pressure reducing means:

1. The provision of a fluid sink at O, as by a pump, flue, rarefaction, implosion or fluid jet.
2. The provision of a thermal source at O causing a decrease of fluid density and thus pressure, as by a hot body or injection of hot fluid or radiation.
3. The provision of a thermal sink along the desired locus, as by heat exchange means dissipative of thermal radiation from the vortex pattern.
4. The provision of a directing means in the form of restraining barriers along some part of the desired locus, as by a physical barrier, a fluid barrier, or electric or magnetic field forces.
5. External field forces capable of producing temperature, density, or pressure gradient in fluid bulk.

Figure 4:
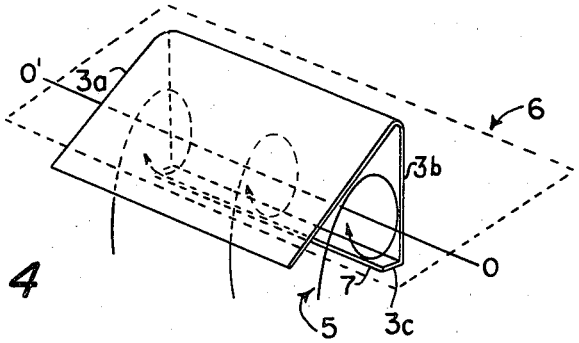
FIG. 4 is a diagramatic view of a preferred embodiment of this invention.

A preferred embodiment illustrated in FIG. 4 employs a combination of the aforelisted means. In this embodiment, the curved wall surface is approximated by flat wall portions 3*a*, 3*b* and 3*c* comparable to portions 1*a*, 1*b* and 1*c* of FIG. 3. FIG. 4 diagramatically illustrates the principles involved in the embodiment of my aforementioned U.S. Pat. No. 4,131,105 and U.S. Pat. No. Re. 30,043. As long as the angle between the instantaneous flow at any locus and the wall is small (less than 40°) stagnation of flow by reason of impingement will be avoided and the flat wall portions function in the same manner as the curved surface. Gas (such as air) is initially supplied to the embodiment of FIG. 4 from a source of gas 11 such as the combustion products of a fire combined with room air described in the devices illustrated in U.S. Pat. No. 4,131,105 and U.S. Pat. No. Re. 30,043. An air flow is established at and is guided into the vortex area by guiding surface 3*a*, having assumed a direction substantially tangential (i.e., less than 30°) to the circumference of the vortex pattern area as defined at this point of entry by surface 3*a*. Guiding surface 3*a* together with gas source 11 operates as a fluid flow forming means. At the angular juncture of surface 3*a* with surface 3*b*, local stagnation occurs which presents an effective wall surface of gas which "rounds" the acute angle of juncture so that the incident angle of flow intersecting surface 3*b* is reduced to below 40°. The flow is then directed by wall portion 3*b* so as to cause it to flow in a second direction through a hypothetical surface indicated as a plane at 6, this plane being established as bounding the incoming air flow parallel to the surface 3*a* and including axis 0–0′. As the flow approaches wall 3*c*, it again encounters an area of local stagnation and is thus redirected to a path parallel to and in the opposite direction of that of the incoming air. It should be noted that at both the juncture between surfaces 3*a* and 3*b*, and at the juncture of surfaces 3*b* and 3*c*, the area of air stagnation constitutes a fluid directing means while the intervening portions of surfaces 3*a*, 3*b* and 3*c* constitute a physical directing means. The redirected air now leaves the terminal edge 7 of surface 3*b* and thus becomes free of the encompassing restraints on the periphery of the vortex area. This terminal edge is spaced from the plane 6 to provide a free vortex expansion area between the redirected air flow and the entering air flow. However, so long as the aforedescribed pressure gradient is maintained, by some type of pressure reducing means 12 such as described above the flow will be pulled toward axis 0–0′ and caused to again cross the plane 6 and reenter the incoming flow path to mingle with the incoming air flow and maintain its presence within the vortex area. Particular examples of pressure reducing means would be a fluid exhaust 14 and/or a heat source 16.

Maintenance of the pressure gradient is readily accomplished by disposing the embodiment of FIG. 4 on a slant so that one end of the axis 0–0′ is elevated with respect to the other. A desirable disposition would be that at which the axis 0–0′ is sloped, at an angle of 20°, and gas is allowed to exhaust from the higher end. Gas will then follow a convoluted path spiraling about the axis 0–0′ toward the higher elevation, each convolution tending to remove gas from the preceeding convolution about 0–0′, thus providing and maintaining a low pressure along axis 0–0′.

An example of a satisfactory structure would have a width of 10″, a length of wall 3*a*=5″, length of wall 3*b*=3″, and length of wall 3*c*=0.5″, and axis 0–0′ sloped at 20°.

Figure 6:
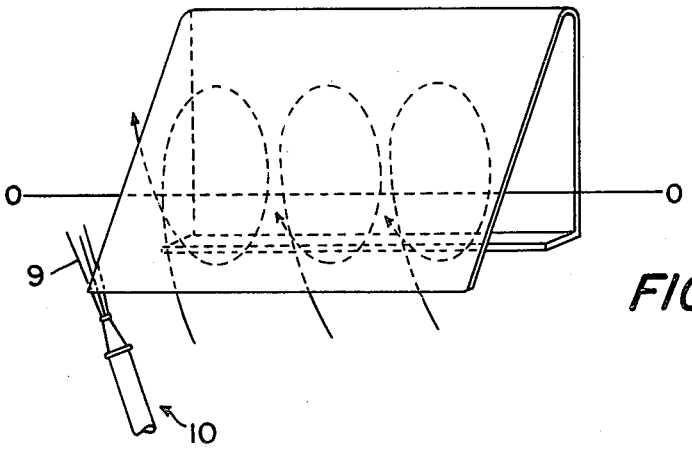
FIG. 6 is a diagramatic view of still another embodiment.

As a supplement to the exhaust flue, a separate fluid stream may be provided at one end of the vortex area in order to exhaust fluid from the vortex area by entraining it in the separate fluid stream, as in the fireplace of my copending applications where air exhausting the vortex area is entrained in the stream of combustion products passing directly from the fire to the flue. Such a structure is depicted diagramatically in FIG. 6, where the separate fluid stream 9 derived from source 10 passes by the exhaust end of the vortex area to entrain fluid exiting the vortex.

These structures provide a stable vortex which will accomodate fluctuations and even temporary reversals of pressure at the exhaust point. When a pressure reversal occurs at the exhaust point, such as a backdraft in an exhaust flue, the momentum of the vortex will result in a pressure build up at the exhaust point. In a restrained vortex, such a build up would be reflected along the axis 0–0′ to upset the pressure gradient and react as a back pressure to incoming gas. However, by virtue of the absence of constraint between the terminal edge 7 and plane 6, the vortex can expand into this unrestrained area, and will recover and pull back inside of the original pattern area if the pressure reversal is relieved before the vortex becomes detached from the pattern area.

In a variation of the aforedescribed embodiment, the ends of the vortex area may be closed, and the pressure gradient maintained by extending a perforated exhaust conduit 18 (FIG. 3) along axis 0–0′ to maintain reduced pressure throughout the length of the axis by intake of fluid through the perforations.

Figure 5:
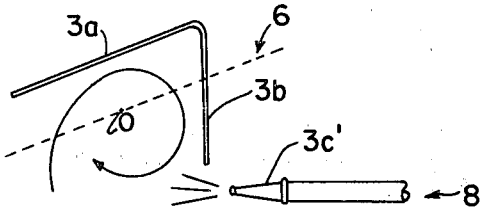
FIG. 5 is a diagramatic view of another embodiment.

FIG. 5 discloses a still further modification illustrative of another example of combined fluid and physical guiding and directing means, which is identical in operation to that of FIG. 4 with the exception that redirecting means 3*c*′ comprises a fluid barrier in the form of a distinct fluid flow tangent to said vortex area and originating at a source 8. This modification is diagramatic of the situation in a fireplace constructed in accordance with my aforementioned copending applications, where the fluid barrier 3c' is room air entering the fireplace access opening and re-directing the vortex flow in the course of its flow as pre-combustion air to the fire.

The foregoing description of various embodiments of my invention have been set forth in detail for the purpose of compliance with the requirements of the first paragraph of 35 USC 112, and is not to be construed as constituting a limitation of this invention, the scope of which is to be determined by a consideration of the following claims:

I claim:

1. A self adjusting, stable fluid vortex generator, comprising (a) fluid flow forming means for establishing a linear fluid flow in a first direction pointing toward a volume having a central axis within which it is desired to generate a stable vortex having a vortical core positioned generally along the central axis, (b) directing means for changing the direction of said fluid flow to cause said fluid to pass through a hypothetical plane which is parallel to said first direction, and intersects said central axis, (c) redirecting means for further changing the direction of said flow about said central axis in a direction opposite to said first direction, said redirecting means terminating short of reentry through said plane to define an unconstrained expansion area between said redirecting means and said plane, and (d) pressure reducing means for reducing the pressure of said fluid in the area of said central axis to sustain a stable vortex having a vortical core positioned generally along said central axis by establishing the necessary pressure gradient across the path of said fluid flow within said volume.

2. A fluid vortex generator as set forth in claim 1, wherein said fluid flow forming means includes guiding means for guiding said fluid flow established by said fluid flow forming means.

3. A fluid vortex generator as set forth in claim 2, wherein said guiding means and said directing means comprise physically restraining walls.

4. A fluid vortex generator as set forth in claim 3, wherein said redirecting means also comprises a physically restraining wall.

5. A fluid vortex generator as set forth in claim 4, wherein said directing means and said redirecting means intersect at an angular juncture the angle of which subtends a local area of fluid stagnation which constitutes additional directing means.

6. A fluid vortex generator as set forth in claim 3, wherein said restraining walls intersect at an angular juncture the angle of which subtends a local area of fluid stagnation which constitutes additional directing means.

7. A fluid vortex generator as set forth in claim 3 wherein said redirecting means comprises a distinct fluid stream passing tangentially to said volume.

8. A fluid vortex generator as set forth in claim 2, wherein said guiding means said directing means, and said redirecting means comprise continuous portions of a curved wall structure.

9. A fluid vortex generator as set forth in claim 2, wherein said pressure reducing means comprises a heat source disposed axially of said central axis.

10. A fluid vortex generator as set forth in claim 1, wherein said pressure reducing means comprises a fluid exhaust positioned at one end of said volume axially thereof.

11. A fluid vortex generator as set forth in claim 10, wherein said central axis is inclined upwardly toward said fluid exhaust means.

12. A fluid vortex generator as set forth in claim 9, wherein the inclination of said central axis is approximately 20°.

13. A fluid vortex generator as set forth in claim 9, wherein said fluid exhaust means comprises a fluid entraining fluid stream.

14. A fluid vortex generator as set forth in claim 1, wherein said pressure reducing means comprises a fluid exhaust means having intake positioned along said central axis.

15. A method of generating a stable vortical pattern of flow of a fluid stream defining a vortex within a volume having a central axis with the vortical core of the vortex being aligned generally with the central axis, said method comprising the steps of (a) introducing said fluid stream into said volume by guiding one side of said stream in a first linear direction generally tangential to the outer circumference of said volume while leaving the other side of said stream free of restriction, said other side defining a hypothetical plane intersecting the central axis of said volume and being oriented generally parallel to the said first linear direction, (b) changing the direction of said fluid stream by directing it in a second direction through said hypothetical plane, (c) again changing the direction of said flow by redirecting the fluid about said central axis in a direction opposite to said first direction, (d) reducing the pressure of said fluid in the area of said central axis to a degree establishing a pressure gradient $$\frac{\delta P}{\delta R} = \frac{\rho R}{k} \theta^2$$

across said stream and centered generally at said central axis where $\delta$=partial differential operator or calculus P=pressure R=distance from vortex axis $\dot{\theta}$=angular velocity k=constant $\rho$=density of fluid and, (e) discontinuing the act of directing said flow about said central axis prior to reentry of said flow through said plane, thus relying on said pressure gradient to pull said flow through an unconstrained expansion area adjacent said plane to reenter said stream in said first direction.

16. A fluid vortex generator comprising (a) fluid flow forming means for establishing a linear fluid flow in a first direction toward a volume having a central axis, (b) pressure reducing means for reducing the pressure of said fluid in the area of said central axis to establish a pressure gradient across the path of said fluid flow within said volume, said pressure reducing means providing a sufficient pressure gradient that said fluid flow moves in a second direction passing through a hypothetical plane unrestrictively bordering said fluid as said fluid moves in said first direction, said plane being parallel to said first direction and intersecting the central axis of the volume, and (c) redirecting means for further changing the direction of said flow about said central axis in a direction opposite to said first direction, said redirecting means terminating short of reentry through said plane to define an unconstrained expansion area between said redirecting means and said plane.

* * * * *